US007631597B2

(12) United States Patent
Dumenil

(10) Patent No.: US 7,631,597 B2
(45) Date of Patent: Dec. 15, 2009

(54) SCREEN PRINTER MACHINE

(75) Inventor: Francois Dumenil, Chaumes en Brie (FR)

(73) Assignee: Machines Dubuit, Noisy-le-Grand (FR)

( * ) Notice: Subject to any disclaimer, the term of this patent is extended or adjusted under 35 U.S.C. 154(b) by 357 days.

(21) Appl. No.: 11/783,480

(22) Filed: Apr. 10, 2007

(65) Prior Publication Data

US 2007/0240588 A1 Oct. 18, 2007

(30) Foreign Application Priority Data

Apr. 12, 2006 (FR) ..... 06 03235

(51) Int. Cl.
*B05C 17/04* (2006.01)

(52) U.S. Cl. ..... 101/123; 101/129; 101/486

(58) Field of Classification Search ..... 101/114, 101/115, 123, 124, 126, 127.1, 129, DIG. 36, 101/481, 485, 486; 33/614, 617, 620, 621
See application file for complete search history.

(56) References Cited

U.S. PATENT DOCUMENTS 5,176,078 A * 1/1993 Homma et al. ..... 101/126
5,241,187 A * 8/1993 Ikeda et al. ..... 250/548
5,619,919 A 4/1997 Karlyn et al.
5,901,646 A * 5/1999 Walker et al. ..... 101/123
6,205,925 B1 * 3/2001 Ohira et al. ..... 101/486
6,568,321 B2 * 5/2003 Sakamoto ..... 101/126

FOREIGN PATENT DOCUMENTS

| | | |
|---|---|---|
| EP | 0 502 239 | 9/1992 |
| WO | WO 99/19145 | 4/1999 |

* cited by examiner

*Primary Examiner*—Ren Yan
(74) *Attorney, Agent, or Firm*—Young & Thompson

(57) ABSTRACT

The screen printer machine includes: a base assembly; at least one print station having a support suitable for receiving a silk screen; and elements for moving the support relative to the base assembly. The elements for moving the support include: three coupling assemblies each provided with a moving member that is movable relative to the base assembly, sliding-connection elements for the moving member, and elements for moving the moving member; and members for controlling the drive elements for moving the three assemblies independently. The moving member of each coupling assembly is connected to the support by the sliding-connection elements along a direction that is fixed relative to the support.

11 Claims, 6 Drawing Sheets

SCREEN PRINTER MACHINE

The invention relates in general to screen printer machines.

FIELD OF THE INVENTION

More precisely, the invention relates to a screen printer machine of the type comprising:

a base assembly;

at least one print station including a support suitable for receiving a silk screen having a pattern for printing thereon; and means for moving the support relative to the base assembly in a displacement plane;

the means for moving the support comprising:

three coupling assemblies each provided with a moving member that is movable relative to the base assembly, sliding-connection means for guiding the moving member in a fixed direction that is parallel to the displacement plane, and drive means for moving the moving member relative to the base assembly, with at least two of the three fixed directions intersecting; and control means for controlling the drive means for moving the three assemblies independently of one another.

BACKGROUND OF THE INVENTION

One such machine is disclosed in U.S. Pat. No. 5,901,646 which describes moving members constituted by carriages connected to the base assembly by sliding-connection means oriented in directions that are fixed relative to the base assembly.

OBJECTS AND SUMMARY OF THE INVENTION

For this purpose, the invention relates to a screen printer machine of the above-specified type, wherein the moving member of each coupling assembly is connected to the support by the sliding-connection means oriented in a direction that is fixed relative to the support.

The machine may also include one or more of the following characteristics considered individually or in any technically feasible combination:

two of the three fixed directions are mutually parallel, the third fixed direction being perpendicular to the other two fixed directions;

two of the three fixed directions are in alignment;

each of the drive means for moving the three assemblies comprises a motor member and a driver suitable for being driven by the motor member to move relative to the base assembly parallel to the displacement plane, the driver being linked via a joint to the moving member;

the driver is suitable for being driven in rotation relative to the base assembly by the motor member;

the driver is a crank having an eccentric rod linked to the moving member;

the driver is suitable for being driven in translation relative to the base assembly by the motor member;

the driver is guided by slideways in translation relative to the base assembly in a direction that is substantially perpendicular to the fixed direction of the sliding-connection means of the same assembly;

the three coupling assemblies are distributed around the periphery of the support;

when seen in a direction perpendicular to the displacement plane, the moving members of the assemblies lie at all times on a circle presenting a center situated in a central portion of the support; and the support is a frame defining a central space in which the silk screen is fastened, the center of the circle, seen in a direction perpendicular to the displacement plane, being situated in the central space.

BRIEF DESCRIPTION OF THE DRAWINGS

Other characteristics and advantages of the invention appear from the detailed description given below by way of non-limiting indication and with reference to the accompanying drawings, in which.

MORE DETAILED DESCRIPTION

Figure 1:
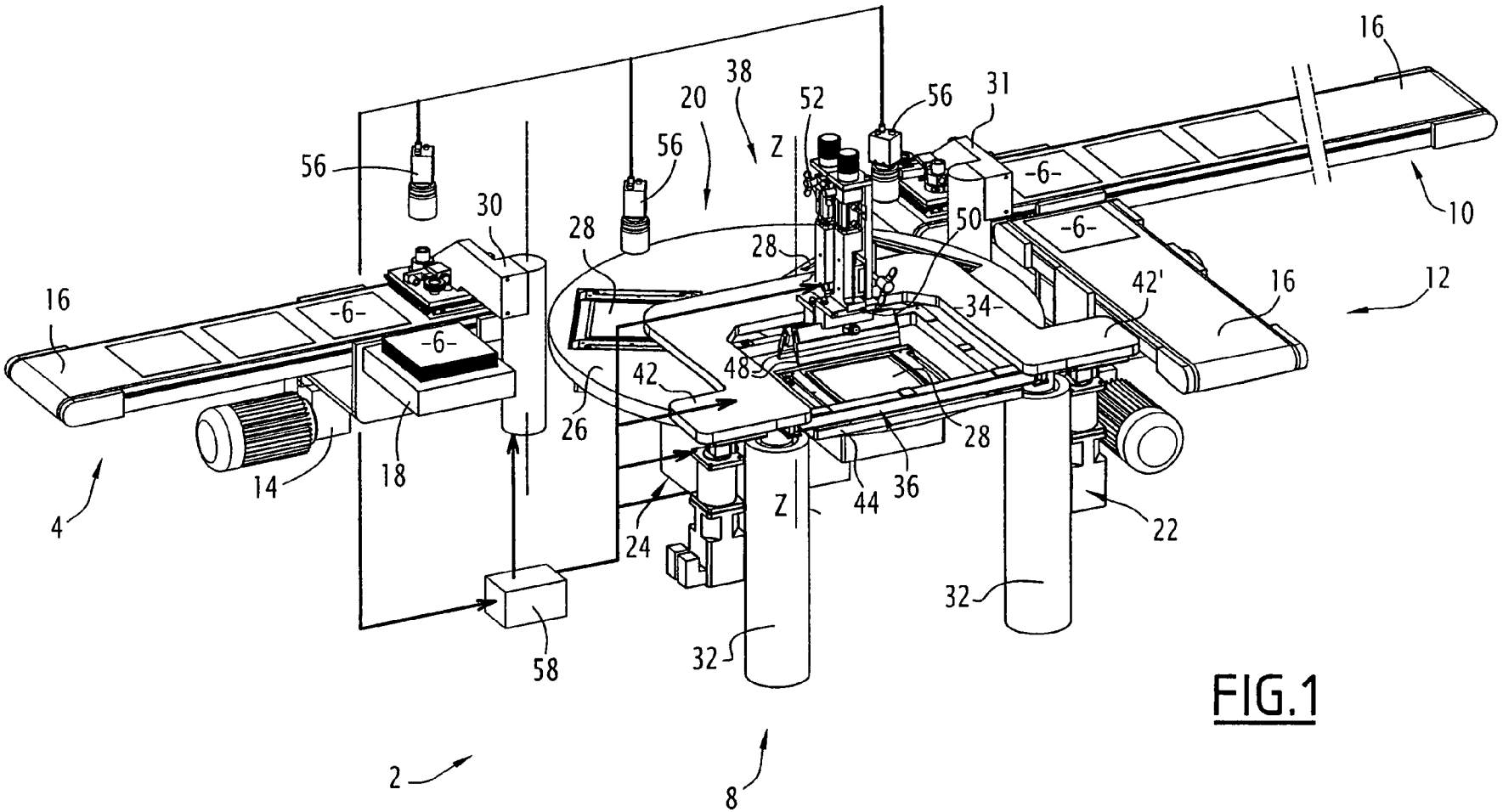
FIG. 1 is an overall perspective view of a screen printer machine in accordance with the invention.

The machine shown in FIG. 1 is for silk-screen printing on flat articles, such as compact disks, telephone cards, or solar cells.

It comprises a feed conveyor 4 for feeding articles for printing 6, a print unit 8, a removal conveyor 10 for removing properly-printed articles, and a removal conveyor 12 for removing badly-printed or defective articles, and extending perpendicularly to the conveyor 10. The conveyors 4, 10, and 12 are similar, each comprising a base structure 14 and a conveyor belt 16 traveling in a loop between two parallel rollers. The machine also comprises a storage tray 18 placed beside the feed conveyor 4 and suitable for receiving a stack of articles 6 for printing when the printer machine is not in operation.

The print unit 8 comprises a turntable 20 situated between the feed and removal conveyors 4 and 10, and a print station 22 situated at least in part over the turntable. The turntable 20 is motor driven and comprises a stationary base assembly 24, and a circular tabletop 26 carried by the base assembly 24. The tabletop 26 is rotatable relative to the base assembly 24 about a vertical axis Z. The top face of the tabletop 26 has three zones 28 for receiving and supporting respective articles 6, the zones being regularly distributed about the axis Z.

A first zone 28 is situated in register with the feed conveyor 4, a second zone in register with the removal conveyor 10, and a third zone under the print station 22.

The first zone 28 is a zone for receiving an article 6 for printing, as fed from the conveyor 4.

The second zone 28 is a zone for supporting the article 6 after it has been printed in the station 22, waiting to be removed to the conveyor 10 or 12.

The third zone 28 is a zone for supporting the article 6 while it is being printed in the station 22.

The machine further comprises a feed jib arm 30 suitable for taking hold of an element 6 situated at the end of the feed conveyor 4, and for transferring it either onto the storage tray 18, or onto the reception zone 28 of the tabletop 26.

The machine also comprises a removal jib arm 31, suitable for taking an article 6 placed in the zone 28 of the tabletop 6 for supporting printed articles, and for transferring it either to the removal conveyor 10, or to the removal conveyor 12.

The base assembly 24 also has two vertical columns 32 for supporting the print station 22. The columns 32 are stationary and stand close to the tabletop 26, being spaced a little away therefrom.

The print station 22 has a substantially horizontal support 34, a silk screen 36 secured to the support 34, and a squeegee and squeegee-support device 38 mounted to move on the support 34. The support 34 (FIGS. 2 and 3) is generally U-shaped, having three rectilinear branches of equal length. It defines a central void 40. The support 34 also has three substantially square tabs 42, 42', and 42" secured to the three branches of the support 34. The tabs 42 and 42' extend towards the outside of the support from its two free ends. The third tab 42" extends outwards from the support from its central branch. The tabs 42, 42', and 42" extend in the same plane as the support 34.

The screen 36 has a rigid square frame 44 and a mesh (not shown) under tension in the center of the frame 44. The mesh is constituted by threads, e.g. threads of silk, placed depending on the pattern that is to be printed on the articles 6. The sides of the frame 44 are of a length that is substantially equal to the length of the branches of the support 34.

The print station 22 also has two angle bars 46 providing flanges for securing the frame 44 against a bottom face of the support 34. The angle bars 46 are disposed under the two opposite and parallel branches of the support 34.

The support 34 is cantilevered over the tabletop 26, so that the screen 36 lies immediately above the zone 28 supporting the article to be printed.

The squeegee device 38 comprises two squeegees 48, a carriage 50 carrying the squeegees 48, means (not shown) for moving the carriage 50 in a horizontal plane relative to the support 34, and an actuator 52 suitable for moving the squeegees 48 vertically relative to the carriage 50.

The print station 8 also has means for moving the support 34 relative to the base assembly 24, both vertically and in a horizontal displacement plane.

The means for moving the support 34 relative to the base assembly 24 in the vertical direction comprise two actuators (not shown) mounted on the columns 32. The means for moving the support 34 horizontally are described below.

The machine 2 includes a set of cameras and detectors 56 and a central unit 58 suitable for controlling the entire machine as a function at least of information delivered by the cameras and detectors 56.

The operation of the printer machine 2 is described briefly below.

The articles for printing 6 are disposed one behind another on the feed conveyor 4. The jib arm 30 takes hold of the article 6 located at the end of the feed conveyor 4 that is closest to the tabletop 26 and transfers it onto the zone 28 that is closest to the conveyor 4.

Simultaneously, the jib arm 31 takes hold of the article 6 that has just been printed in the print station 22 and transfers it onto the removal conveyor 10. This article is initially located in the zone 28 of the tabletop 26 that is closest to the conveyor 10.

Likewise in simultaneous manner, the article 6 that is located in the third zone 28 under the support 34 is subjected to printing. For this purpose, the support 34 is initially lowered so as to bring the screen 36 immediately above the article 6 for printing. Then, using the means for moving the support in the horizontal displacement plane, the position of the screen 36 is brought accurately into register with the article 6.

The actuators 52 then displace the squeegees 48 downwards, so that the squeegees press the mesh of the screen 36 against the article 6. The carriage 50 then moves relative to the support 34 so that the squeegees 38 sweep over the mesh 36 while keeping it pressed against the article 6, thereby printing thereon the pattern that is defined by the mesh. The squeegees 48 are then raised by the actuators 52, and the carriage 50 returns to its initial position. The support 34 is moved upwards relative to the tabletop 26. Thereafter the tabletop 26 is turned through 120°, so as to bring the zone 28 carrying the recently-printed article 6 to the vicinity of the removal conveyor. This same movement brings the zone 28 carrying the article 6 that has recently been placed on the tabletop 26 under the print unit 22.

There follows a detailed description of the means for moving the support 34 relative to the base assembly 24 in the horizontal plane. The function of these means is to adjust the position of the screen 36 accurately relative to the article 6 for printing, as a function of data supplied by the camera 56 placed over the zone 28 that is closest to the feed conveyor 4. This camera 56 is suitable for detecting the precise position of the article 6 placed on this zone by the jib arm 30, with the control unit 58 calculating the position that the screen support 34 needs to occupy during printing as a function of said data.

The means for moving the support 34 relative to the base assembly 24 comprise three coupling assemblies 60, 60', and 60" all of the same type. Each assembly 60, 60', 60" has a respective slideway 62, 62', 62" rigidly secured under a respective one of the tabs 42, 42', 42" of the support. Each assembly also comprises a moving carriage 64 guided by the corresponding slideway 62, 62', 62" in a direction that is fixed relative to the support 34 and that is parallel to the horizontal displacement plane. Each assembly also has drive means 66 for moving the carriage 64 relative to the base assembly 24.

Figure 5:
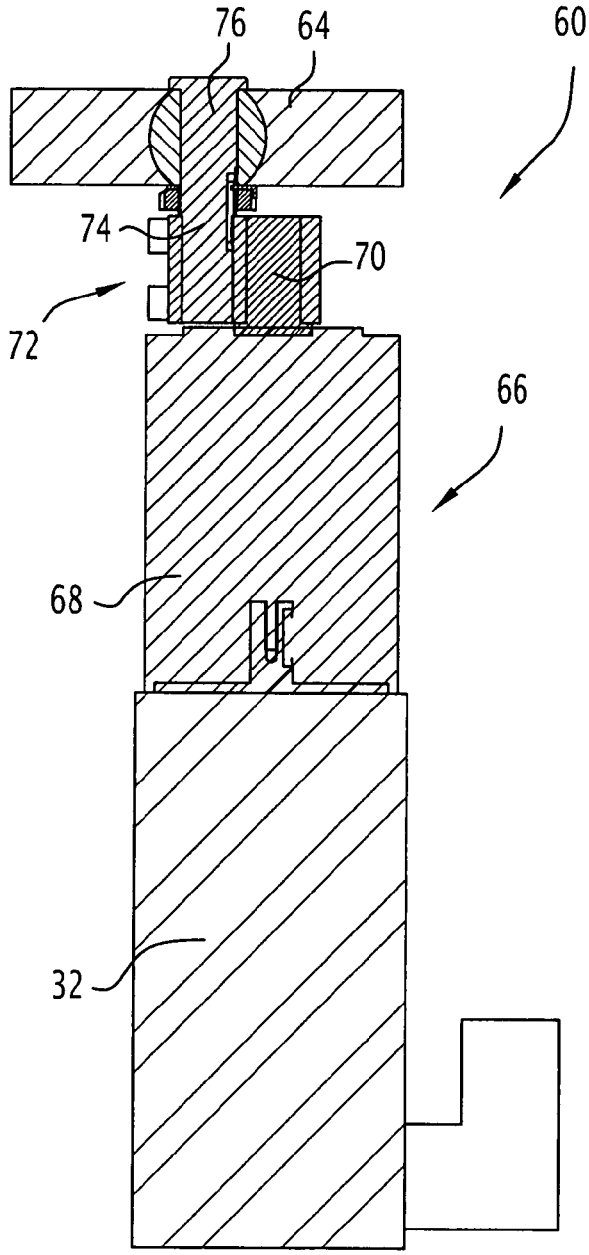
FIG. 5 is an axial section view of the coupling assembly of FIG. 4, seen looking in the direction of arrows V.

In a first embodiment of the invention, shown in FIGS. 2 to 5, the displacement means 66 of each coupling assembly comprise a motor 68, a vertical outlet shaft 70 driven in rotation by the motor 68, and a crank 72 fastened on the outlet shaft 70 (see FIG. 5). The crank 72 has an eccentric rod 74 that is offset horizontally from the shaft 70 and that extends vertically beyond the shaft over a segment 76. The segment 76 is mounted on the carriage 64 by a ball joint. The ball joint occupies substantially the center of the carriage 64.

Figure 2:
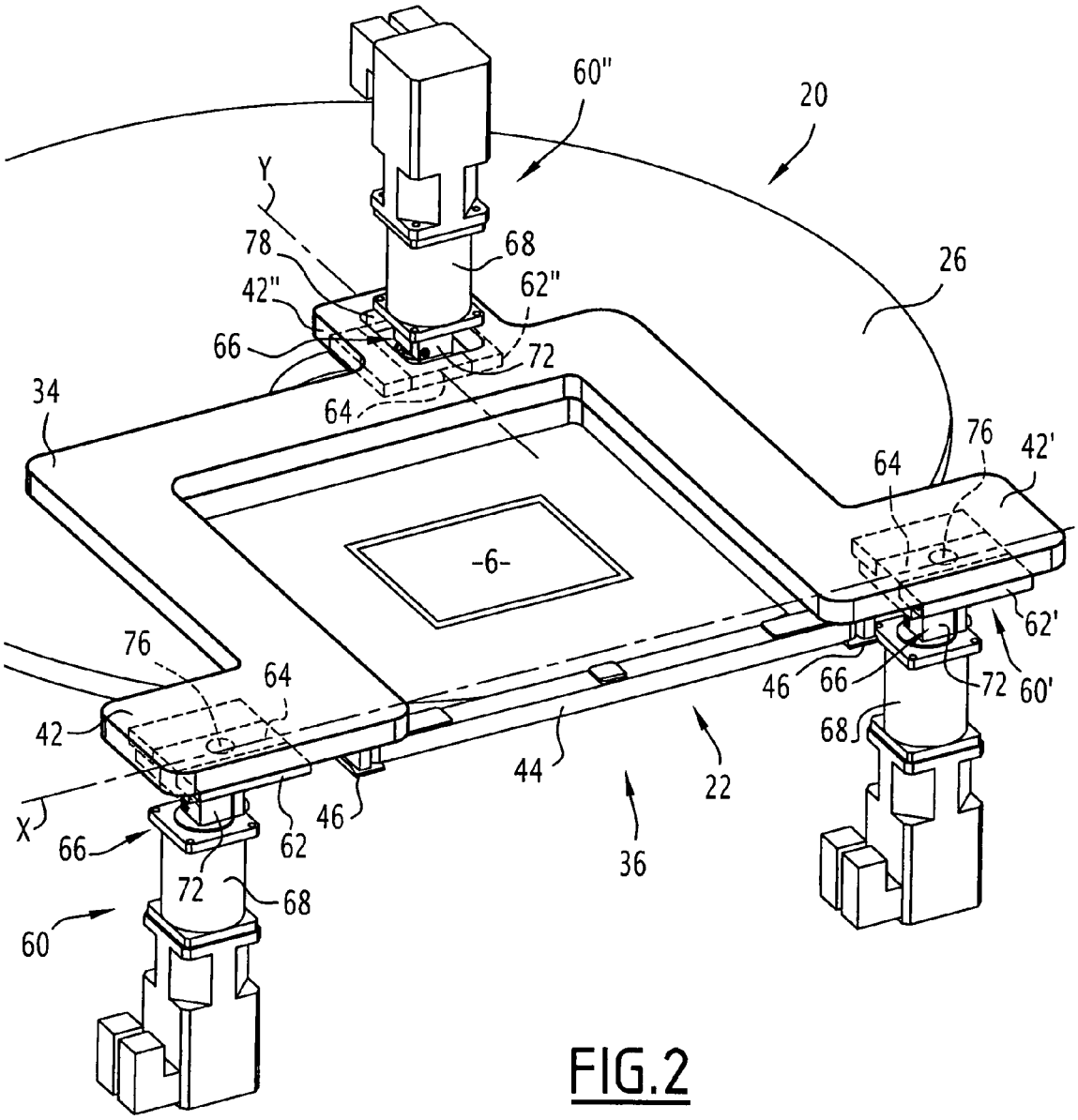
FIG. 2 is a perspective view of the screen support and of the coupling assemblies of the FIG. 1 machine, in a first embodiment of the invention.

As can be seen in FIG. 2, the slideways 60 and 60' of the tabs 42 and 42' guide the carriages 64 in directions that are in alignment. The slideway 60" of the third coupling assembly guides the corresponding carriage in a direction perpendicular to that of the other two slideways 60 and 60'.

Figure 3:
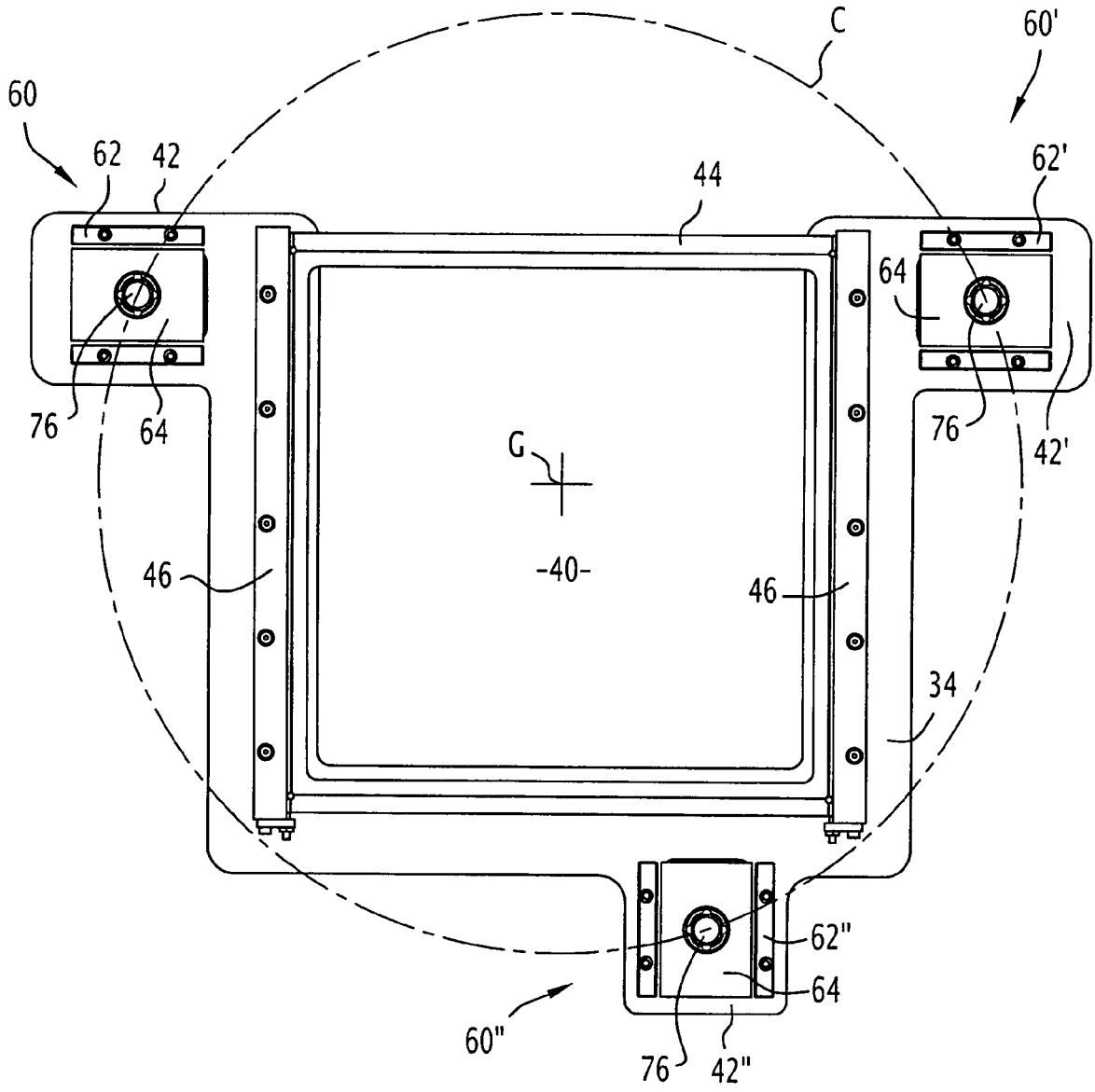
FIG. 3 is a view from beneath of the FIG. 2 support.
Figure 4:
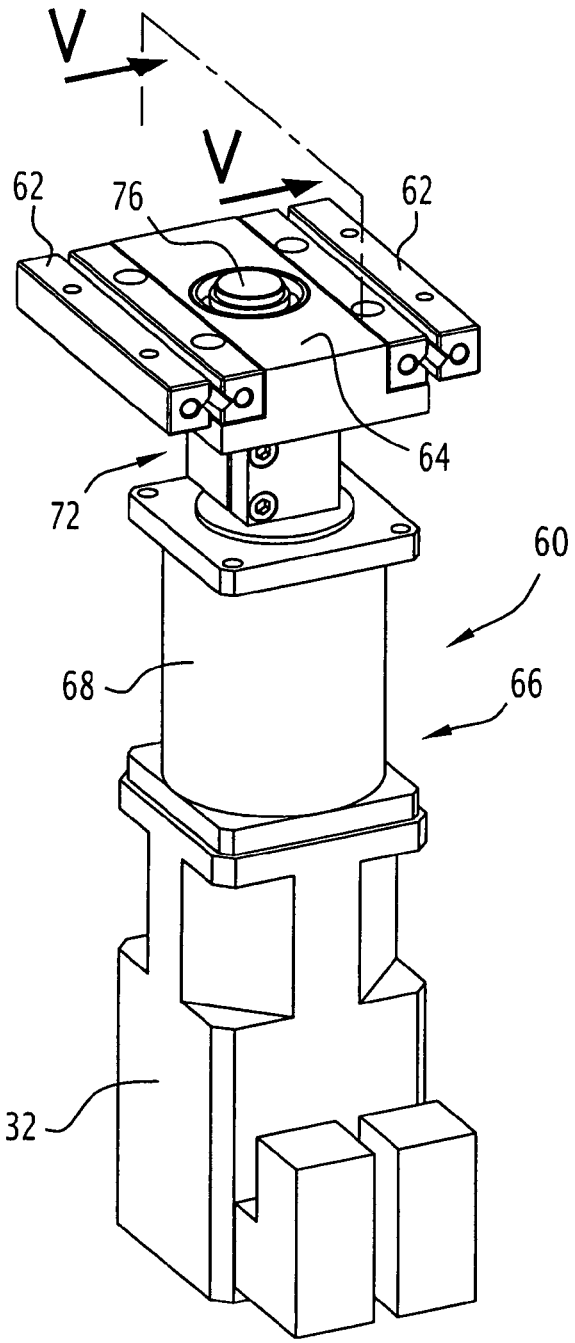
FIG. 4 is a perspective view of a coupling assembly of FIG. 2.

As shown in FIG. 3, the three coupling assemblies are distributed around the periphery of the support 34. When considered in a direction perpendicular to the displacement plane, the moving members 64 of the three coupling assemblies lie at all times on a circle C shown in FIG. 3, the circle C being defined as the circle passing through the ball joints of all three carriages 64. The center G of the circle C is situated at all times in the space 40. The carriages 64 are located around the center G so as to be spaced apart from one another by angles lying in the range 90° to 150°.

The drive means 66 of the coupling assemblies 60 and 60' are located below the support 34, as shown in FIG. 2. More precisely, they are interposed between the top ends of the columns 32 and the bottom faces of the tabs 42 and 42'.

In contrast, the drive means 66 of the third coupling assembly 60" are disposed above the support 34, as can be seen in FIG. 2. They are secured to a jib arm (not shown) that is stationary relative to the base assembly 24. This bracket is supported by the columns 32, for example. The tab 42" is pierced in its center by a square orifice 78. The slideways 62" of the assembly 60" are fastened under the tab 42" on either side of the orifice 78. They extend parallel to two opposite sides of the square orifice 78. The carriage 64 is situated immediately under the orifice 78. The motor 68 is situated above the orifice 78, the crank 72 being engaged in the orifice. The size of the orifice 78 is sufficient to allow the crank 72 to turn about the axis 70 of the motor.

The motors 68 of the three coupling assemblies 60, 60', 60" are micrometer motors controlled by the central unit 58. They enable very high accuracy to be obtained in positioning the carriages 64.

The operation of the means for moving the support 34 is described in detail below.

After the element 6 has been placed in the zone 28 of the tabletop 26 by the jib arm 30, its precise position is evaluated using the camera 56 situated above the zone 28, which camera sends information to the central unit 58.

The tabletop 26 then turns about its axis Z so as to bring the element 6 under the print station 22. As a function of the information received from the camera 56, the central unit 58 controls the motors 68 of the three coupling assemblies 60, 60', and 60" in such a manner as to adjust the position of the screen 36 accurately with three degrees of freedom relative to the element 6.

These three degrees of freedom are movement of the screen 36 in translation along the direction X corresponding to the displacement direction of the two aligned carriages 64 of the assemblies 60 and 60', movement of the screen 36 in translation along the direction Y corresponding to the displacement direction of the carriage of the third assembly 60", and movement of the screen 36 in rotation about an axis perpendicular to the horizontal displacement plane of the support. The movements made possible by these three degrees of freedom enable all possible positions of the screen 36 relative to the element 6 to be obtained as defined by the movements of the carriages. Conversely, there is only one possible combination of positions for the carriages 64 that enables the screen 36 to reach the desired position relative to the element 6 for printing.

This combination of positions is determined by the central unit 58, using mathematical equations recorded in its memory, and on the basis of the information provided by the camera 56.

In order to adjust the position of the screen 36, the central unit 58 controls movement in rotation of the cranks 72 by means of the motors 68.

For the assembly 60, moving the crank 72 in rotation causes the corresponding carriage 64 to move in translation along the direction X relative to the slideways 62 and also causes the tab 42 to move along the axis Y. Simultaneously, movement of the crank 72 in the assembly 60' causes the corresponding carriage 64 to move in the direction X and the corresponding tab 42' to move in the direction Y. Movement of the crank 72 in the third assembly 60" causes the corresponding carriage 74 to move in the direction Y and causes the corresponding tab 42" to move in the direction X.

These three coordinated movements are calculated by the central unit 58 so as to guide the support 34 along an achievable trajectory that brings the support into the desired position.

Once the silk screen is in place, the central unit 58 activates the actuators, thereby enabling the screen to be lowered to a position very close to the element 6 for printing, and causes the squeegees to be moved.

Figure 6:
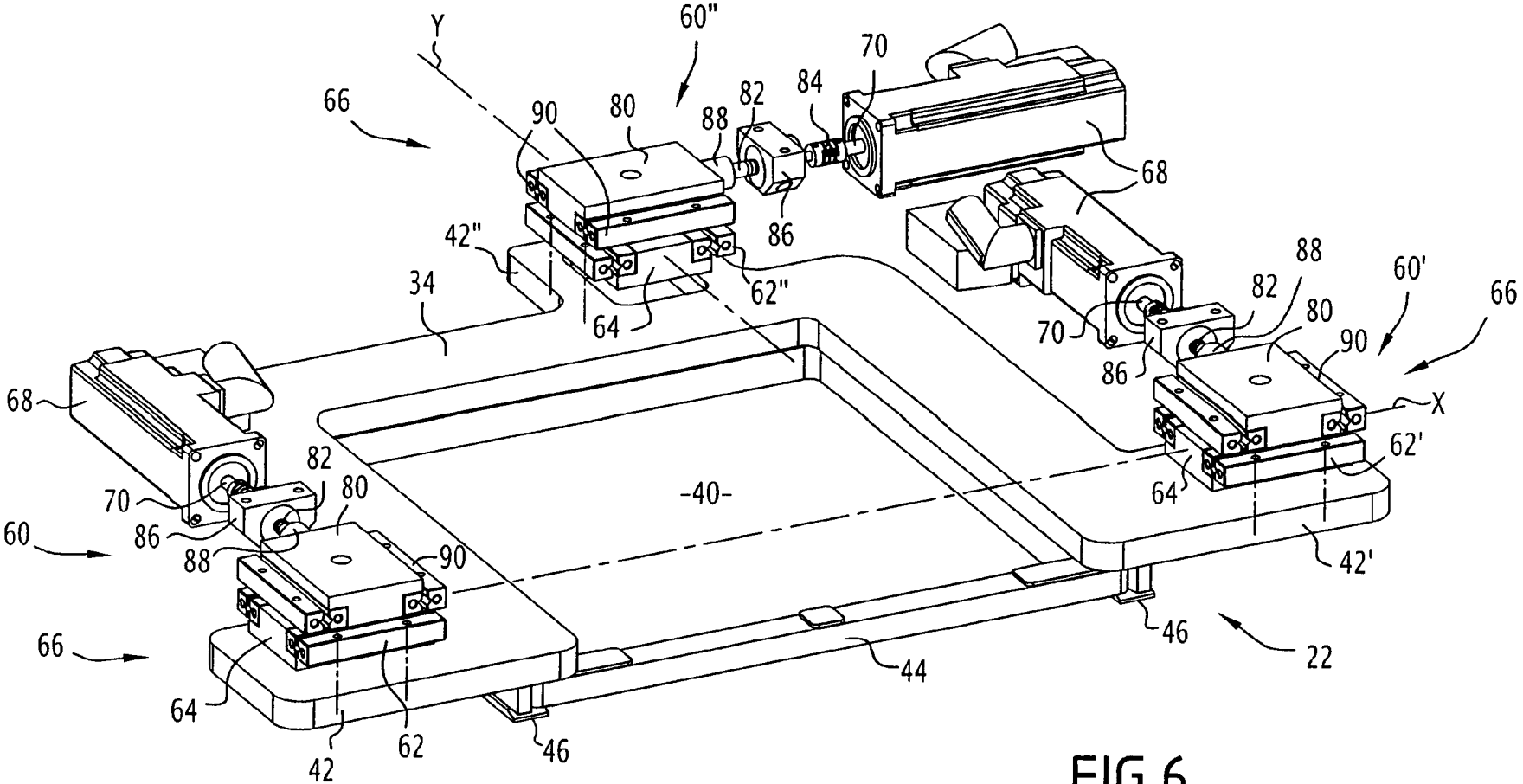
FIG. 6 is a perspective view of the support and of the coupling assemblies of a machine in a second embodiment of the invention.
Figure 7:
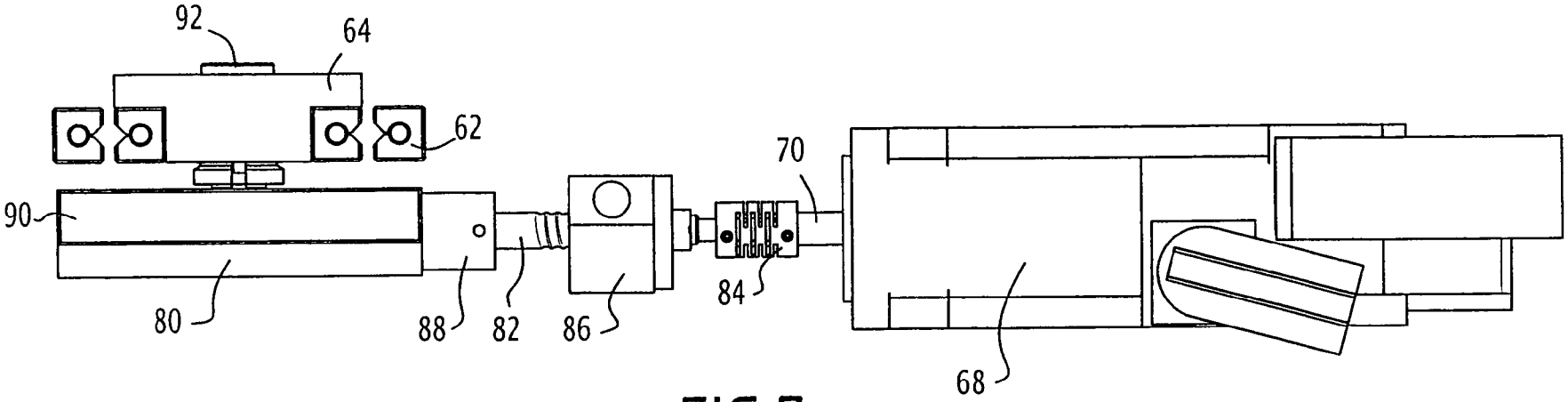
FIG. 7 is a side view of the coupling assembly of FIG. 6.
Figure 8:
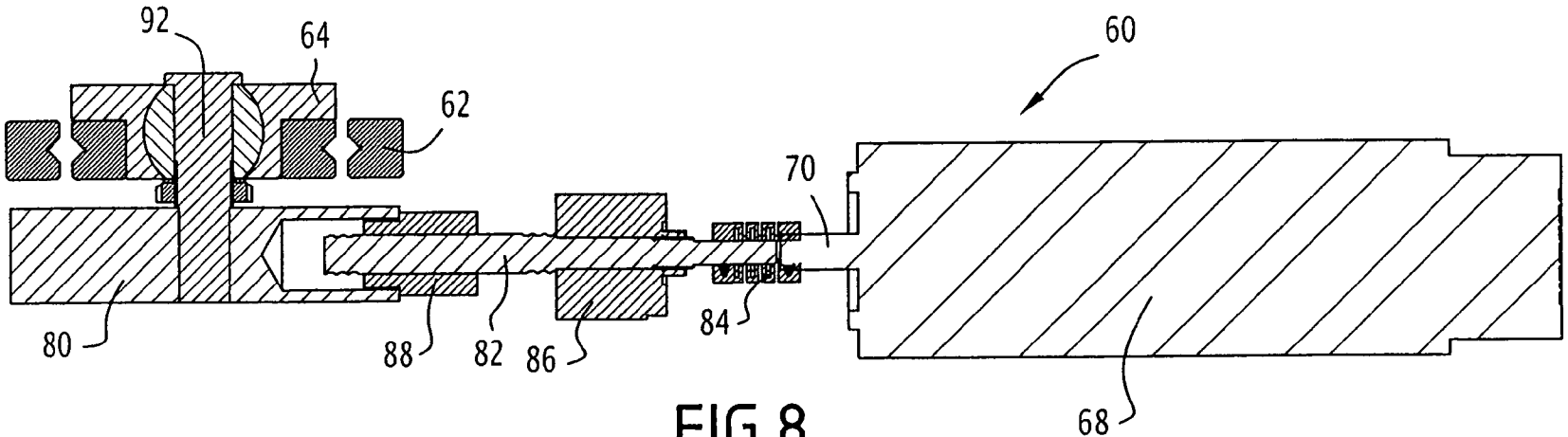
FIG. 8 is an axial section view of the coupling assembly of FIG. 7.

FIGS. 6 to 8 show a variant embodiment of the means for moving the support 34.

As can be seen in FIG. 6, in this embodiment, the slideways 62, 62', and 62" are rigidly fastened on a top face of the support 34, on the tabs 42, 42', and 42". These slideways guide the carriages 64 along the same directions X and Y as in the first embodiment.

The motors 68 are located above the support 34 and are rigidly fastened to a structure that is stationary relative to the base assembly 24, this structure not being shown for greater clarity.

The drive means for moving the carriage 64 of the assembly 60 are shown in greater detail in FIGS. 7 and 8. They comprise an intermediate carriage 80 located above the carriage 64, a wormscrew 82 placed in line with the drive shaft 70, a coupling 84 constraining the wormscrew 82 to rotate with the shaft 70, a bearing 86 for guiding rotation of the screw 82, and a nut 88 rigidly fastened to the intermediate carriage 80. The drive means 66 further comprise intermediate slideways 90 for guiding the intermediate carriage 80. These intermediate slideways 90 and the bearing 86 are rigidly fastened to the support structure of the motors 68.

For the coupling assemblies 60 and 60', the slideways 90 guide the intermediate carriages 80 in the direction Y. The drive shaft 70 and the wormscrew 82 also extend in the direction Y.

For the coupling assembly 60", the intermediate slideways 90 guide the intermediate carriage 80 in the direction X. The outlet shaft 70 and the wormscrew 82 thus extend in said direction X.

In this second embodiment, the central unit 58 controls rotary drive of the wormscrew 82 by means of the motors 68, with the intermediate carriages 80 thus being driven in translation.

Finally, the carriage 64 is hinged to the intermediate carriage 80 about a pin 92 extending perpendicularly to the two carriages. This pin 92 is rigidly fastened to the center of the carriage 80 and it is connected by a ball joint to the center of the carriage 64.

The above-described printer machine presents multiple advantages.

The means for moving the screen support 34 relative to the base assembly in the displacement plane are particularly simple, mechanically speaking. The support is moved by three coupling assemblies comprising three motor-driven carriages and sliding-connection means between the carriages and the support. These three assemblies are controlled by a central unit in coordinated manner, thus enabling the position and the orientation of the silk screen to be adjusted freely relative to the element to be printed in a manner that is fast and accurate.

The means for moving the support are particularly compact. The carriage drive motors are of small size, and the support drive means (slideways, carriage, means for driving the carriage by the motor) are compact, both in the first embodiment and in the second.

As a result, visibility of on-going printing operations is improved for operators, as is accessibility to the silk screen.

Operators can thus monitor the progress of operations more easily and can intervene more conveniently and more quickly whenever necessary.

Finally, it is possible to implement actuators that are fast and accurate (motor 68) so that the printer machine has a rate of throughput that is high.

The above-described machine can present multiple variants.

The three slideways and the corresponding carriages may be disposed in the same plane. It is also possible for the slideways to be disposed in planes that are parallel to the displacement plane, but different from one another.

The disposition of the coupling assemblies at the periphery of the support is selected so as to facilitate guidance of the support by coordinated movements of the carriages. In this context it is advantageous to place one of the two assemblies along each of the branches of the support. The carriages thus lie on a circle of center G that is situated in the central space of the support, thus making guidance of the support easier and more accurate. It should be observed that the movements of the carriages are of small amplitude relative to the size of the support, so that the center G of the circle remains at all times within the central space.

As described above, two of the three carriages may be guided by slideways in directions that are in alignment, the third carriage being guided in a direction that is perpendicular to the preceding direction. This disposition is particularly advantageous, since the mathematical equations enabling the central unit to determine the desired position for the screen and the trajectory to be followed by each carriage to enable this position to be reached are particularly simple. Nevertheless, it is possible to place the slideways in such a manner as to guide the three carriages along three directions that are different from one another. These various directions may be at arbitrary inclinations relative to one another. Nevertheless, it is appropriate to avoid all three guide directions being mutually parallel, since it is then not possible to guide the support. At least two of the three directions must intersect. It is also appropriate to avoid placing the three coupling assemblies on a single line, since it is then impossible to guide the support.

The drive means for moving the carriages may comprise means for driving the carriages by the motors of types that are other than those described above. The drive means may be of the rack-and-pinion type, or indeed of the pivoting-lever type. It should be observed that the three coupling assemblies may have different drive means, one of the coupling assemblies having means for driving the carriage using a crank while the other two have means using a wormscrew, for example.

What is claimed is:

1. A screen printer machine comprising:

a base assembly;

at least one print station including a support suitable for receiving a silk screen having a pattern for printing thereon; and means for moving the support relative to the base assembly in a displacement plane, the means for moving the support comprising three coupling assemblies each provided with a moving member movable relative to the base assembly, sliding-connection means for guiding the moving member in a fixed direction parallel to the displacement plane, and drive means for moving the moving member relative to the base assembly, with at least two of the three fixed directions intersecting; and control means for controlling the drive means for moving the three assemblies independently of one another, wherein the moving member of each coupling assembly is connected to the support by the sliding-connection means oriented in a direction fixed relative to the support.

2. The machine according to claim 1, wherein two of the three fixed directions are mutually parallel, the third fixed direction being perpendicular to the other two fixed directions.

3. The machine according to claim 1, wherein two of the three fixed directions are in alignment.

4. The machine according to claim 1, wherein each of the drive means for moving the three assemblies comprises a motor member and a driver configured to be driven by the motor member to move relative to the base assembly parallel to the displacement plane, the driver being linked via a joint to the moving member.

5. The machine according to claim 4, wherein the driver is configured to be driven in rotation relative to the base assembly by the motor member.

6. The machine according to claim 5, wherein the driver is a crank having an eccentric rod linked to the moving member.

7. The machine according to claim 4, wherein the driver is configured to be driven in translation relative to the base assembly by the motor member.

8. The machine according to claim 7, wherein the driver is guided by slideways in translation relative to the base assembly in a direction substantially perpendicular to the fixed direction of the sliding-connection means.

9. The machine according to claim 1, wherein the three coupling assemblies are distributed around the periphery of the support.

10. The machine according to claim 9, wherein, when seen in a direction perpendicular to the displacement plane, the moving members of the assemblies lie at all times on a circle presenting a center situated in a central portion of the support.

11. The machine according to claim 10, wherein the support is a frame defining a central space in which the silk screen is fastened, the center of the circle, in a view perpendicular to the displacement plane, being situated in the central space.

* * * * *